US008187044B2

(12) United States Patent
Jemt

(10) Patent No.: US 8,187,044 B2
(45) Date of Patent: May 29, 2012

(54) WATERCRAFT PROPULSION DEVICE INCLUDING A LINKAGE AND A HORIZONTAL PROPULSION FIN

(75) Inventor: Thomas Jemt, Ekerö (SE)

(73) Assignee: Dolprop Industries AB, Stockholm (SE)

( * ) Notice: Subject to any disclaimer, the term of this patent is extended or adjusted under 35 U.S.C. 154(b) by 145 days.

(21) Appl. No.: 12/743,202

(22) PCT Filed: Nov. 20, 2008

(86) PCT No.: PCT/SE2008/051330

§ 371 (c)(1),
(2), (4) Date: Jul. 7, 2010

(87) PCT Pub. No.: WO2009/067078

PCT Pub. Date: May 28, 2009

(65) Prior Publication Data

US 2010/0291811 A1 Nov. 18, 2010

Related U.S. Application Data

(60) Provisional application No. 60/989,482, filed on Nov. 21, 2007.

(30) Foreign Application Priority Data

Nov. 21, 2007 (SE) ..... 0702562

(51) Int. Cl.
*B63H 1/36* (2006.01)

(52) U.S. Cl. ..... 440/13; 440/15; 440/21

(58) Field of Classification Search ..... 440/6, 13–15, 440/18, 21
See application file for complete search history.

(56) References Cited

U.S. PATENT DOCUMENTS

| | | | | | |
|---|---|---|---|---|---|
| 923,283 | A | * | 6/1909 | Loomer | 440/14 |
| 2,364,255 | A | * | 12/1944 | Troth | 440/14 |
| 3,110,283 | A | * | 11/1963 | Warner | 440/15 |
| 3,336,897 | A | * | 8/1967 | Jeney | 440/13 |
| 4,354,848 | A | * | 10/1982 | Hall et al. | 440/61 R |
| 4,960,396 | A | * | 10/1990 | Stolzer | 440/21 |
| 5,370,561 | A | * | 12/1994 | Jakobsen | 440/14 |
| 2004/0266279 | A1 | | 12/2004 | Jelten | |

FOREIGN PATENT DOCUMENTS

| | | | |
|---|---|---|---|
| DE | 7424692 | U | 11/1944 |
| DE | 2346051 | A1 | 3/1975 |
| GB | 21272 | A | 0/1911 |
| JP | 55-55091 | A | 4/1980 |

* cited by examiner

*Primary Examiner* — Stephen Avila
(74) *Attorney, Agent, or Firm* — Birch, Stewart, Kolasch & Birch, LLP

(57) ABSTRACT

A watercraft propulsion device 10 has a linkage comprising a vertical drive link (20), a support link (12), an upper control link (50) having a forwardly extended handle bar (52), and a lower propulsion link (30) having a horizontal propulsion fin (32) backwardly extended therefrom. The control and propulsion links (50, 30) are interconnected by said drive link (20), which is capable of conveying propulsive oscillatory motion to the propulsion link (30) by means of a linear power actuator (90), and by the support link (12), which is pivotally connected a transom bracket (60) about a substantially vertical axis.

20 Claims, 4 Drawing Sheets

WATERCRAFT PROPULSION DEVICE INCLUDING A LINKAGE AND A HORIZONTAL PROPULSION FIN

FIELD OF THE INVENTION

The present invention relates to a watercraft propulsion device including a linkage comprising a vertical drive link for a horizontal propulsion fin.

BACKGROUND OF THE INVENTION

A boat having a propulsion device of this type is disclosed in DE 2346051. In this device a drive link is connected to a forwardly extended lever that is subjected to manual pumping movements by the user for oscillating the propulsion fin. The lever is also pivotably connected to a rudder, which is pivotably connected to brackets extending from the stem of a small boat. A problem with the propulsion device of DE 2346051 is that it is difficult to keep the course of the watercraft.

SUMMARY OF THE INVENTION

An object of the invention is to further develop a watercraft propulsion device of the above mentioned kind so that it can be easily steerable. Other objects are apparent from the description below.

In an aspect of the invention there is provided a watercraft propulsion device including a linkage, which comprises a drive link, a support link, an upper control link having a forwardly extended handle bar, and a lower propulsion link having a propulsion fin extending backwards therefrom, said control and propulsion links being interconnected by said drive link, which is capable of conveying propulsive oscillating motion to the propulsion link, and by said support link. The linkage is pivotally connected to a transom bracket, such that it can pivot relative to the transom bracket about a substantially vertical axis.

Preferably, the transom bracket is configured to be releasably fixed to a transom. In this manner, the propulsion device is made easily attachable to and detachable from a watercraft, which is useful e.g. when rowing, since drag of the propulsion device can be avoided by removing the propulsion device.

Since the linkage is also capable of being turned about the vertical axis, the forwardly extending portion of the control handle can be used as a tiller for steering the watercraft as in an outboard engine.

In one embodiment, said control and propulsion links are interconnected rearwardly by said drive link, and forwardly by said support link, said support link being pivotally connected to said transom bracket about said substantially vertical axis. Preferably, the support link comprises a shaft, which is rotatably and non-slidably supported in a bearing sleeve connected to the transom bracket.

In one embodiment, said control link is pivotally connected to an upper end of the support link for generating said propulsive oscillatory motion by manual pumping movements of said handle bar.

While the propulsive force can be obtained by manual pumping of the handle bar, in another embodiment, one of the objectives of the present invention is obtained by a watercraft propulsion device including a linkage, which comprises a vertical drive link, a support link, an upper control link having a forwardly extended handle bar, and a lower propulsion link having a horizontal propulsion fin extending backwards therefrom, said control link and said propulsion link being interconnected by said support link and by said drive link, which is capable of conveying propulsive oscillatory motion to the propulsion link, said linkage being pivotally connected to a transom bracket such that it can pivot about a substantially vertical axis, the propulsion device further comprising a linear power actuator included in said drive link for generating said oscillatory motion.

Preferably, the linear power actuator is an electric, a pneumatic, or a hydraulic motor. Thanks to the linear power actuator, there will be no pumping movements of the tiller handle bar that have a negative impact on the course stability of the watercraft.

In a further embodiment of the invention the propulsion link comprises a forward support body connected to the propulsion fin. Thereby the flexible propulsion fin can be made capable of flexing freely rearward of the pivot joints of the propulsion link to efficiently move forward in a surrounding water volume.

If the support body is made of a flexible plastics material integrally formed with the propulsion fin, the propelling movements of the resulting propulsion link may be made more resembling those of a dolphin tail for higher propulsive efficiency. The support body may also have a streamline shape.

Other features and advantages of the invention are apparent from the appended claims and the following detailed description of exemplary embodiments.

BRIEF DESCRIPTION OF THE DRAWINGS

In the drawing, components having similar function are designated by the same numerals.

DETAILED DESCRIPTION OF THE EXEMPLARY EMBODIMENTS

Figure 1:
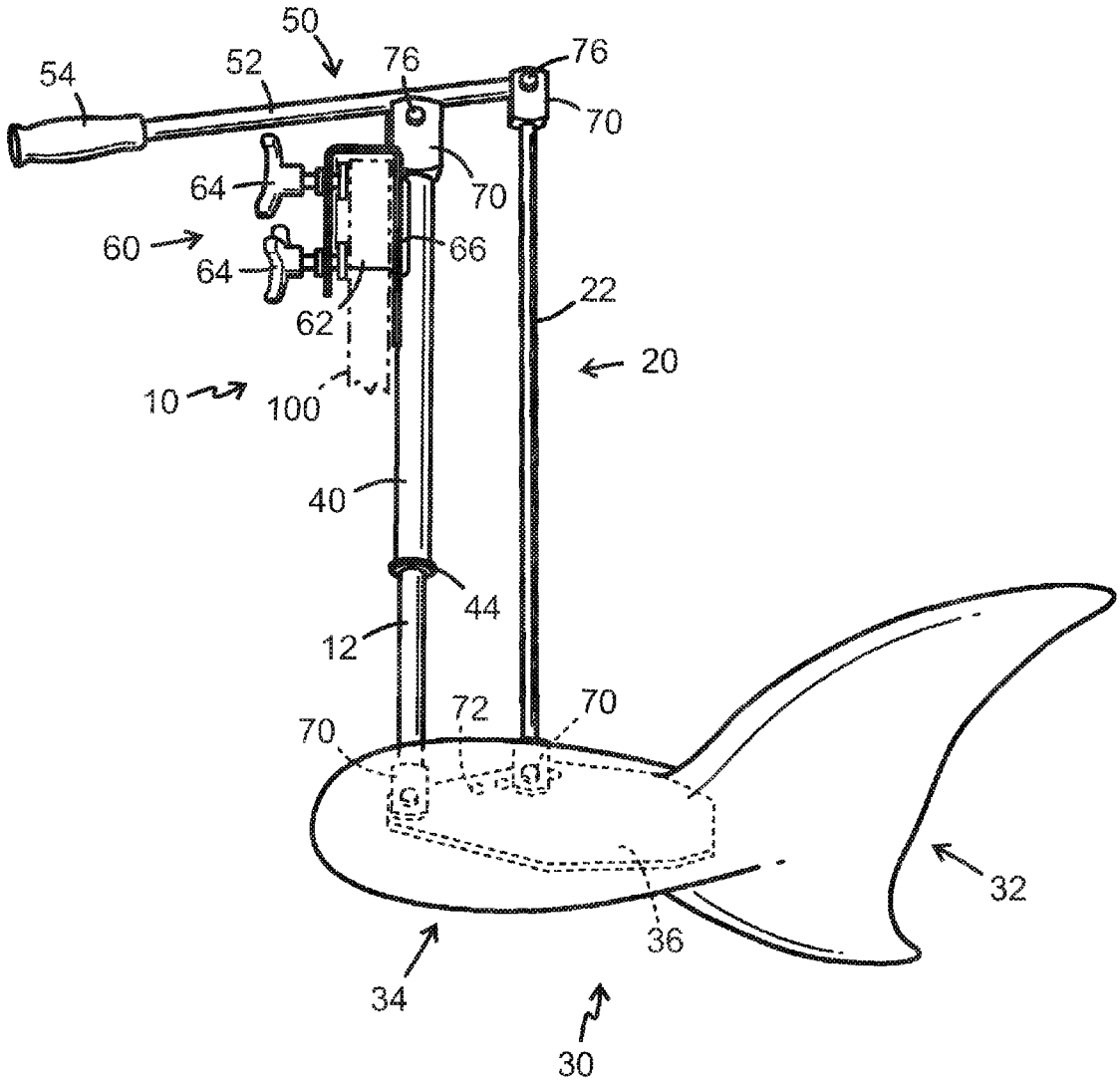
FIG. 1 is a perspective view from below of a watercraft propulsion device.

The watercraft propulsion device 10 shown on the drawing generally comprises substantially a parallelogram linkage comprising a support link 12 and a drive link 20 that are interconnected by an upper control link 50 and a lower propulsion link 30.

More precisely, the parallelogram linkage included in the propulsion device 10 is arranged as follows: The upper control link 50 is forwardly extended by a handle bar 52 having a handle grip 54. The lower propulsion link 30 comprises a fore support body 34 and an aft extended flexible propulsion fin 32. Between the control and propulsion links 50, 30 there is forwards the support link 12 and rearwards the drive link 20.

Figure 2:
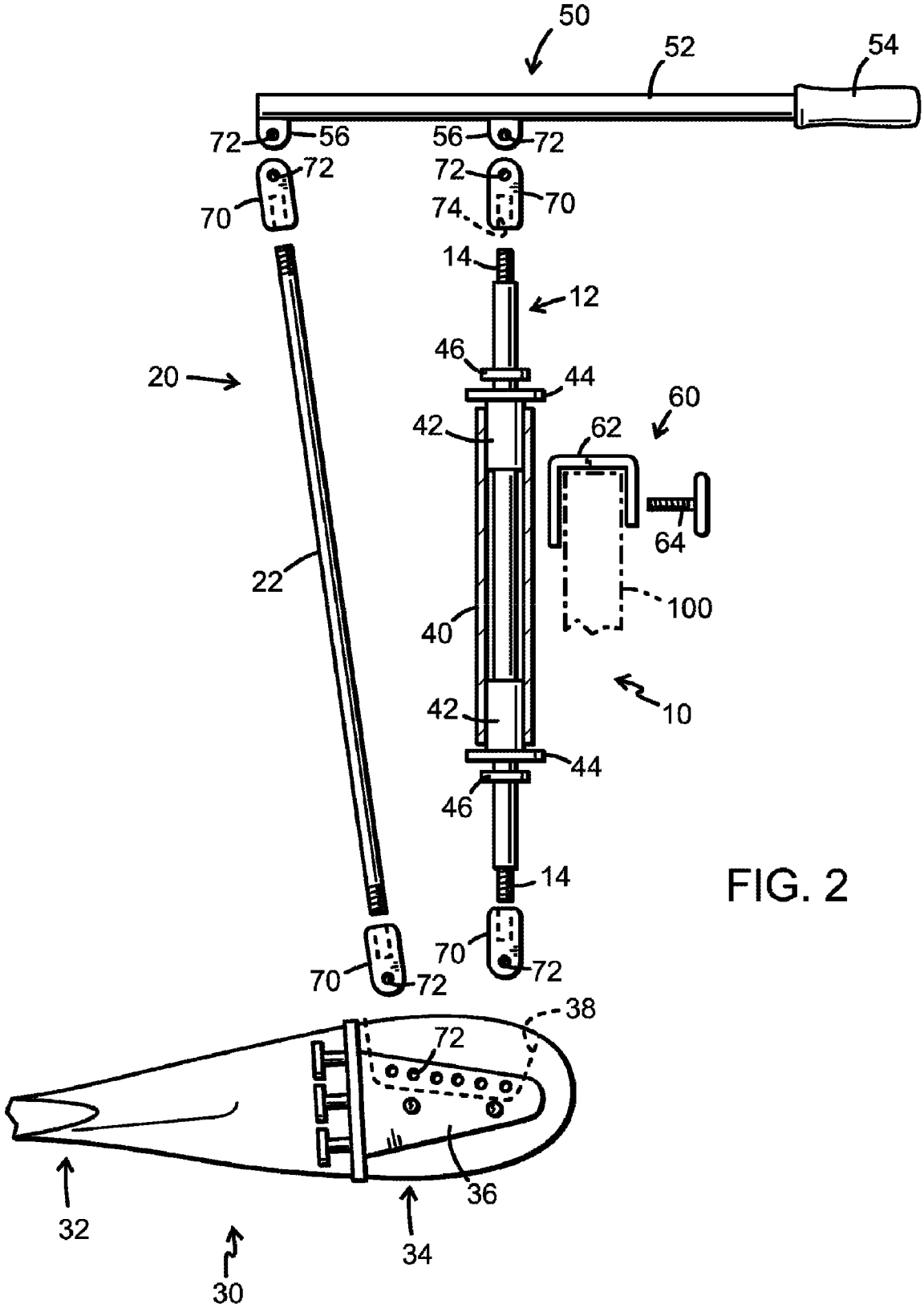
FIG. 2 is an exploded lateral view, partly in section of a watercraft propulsion device.
Figure 3:
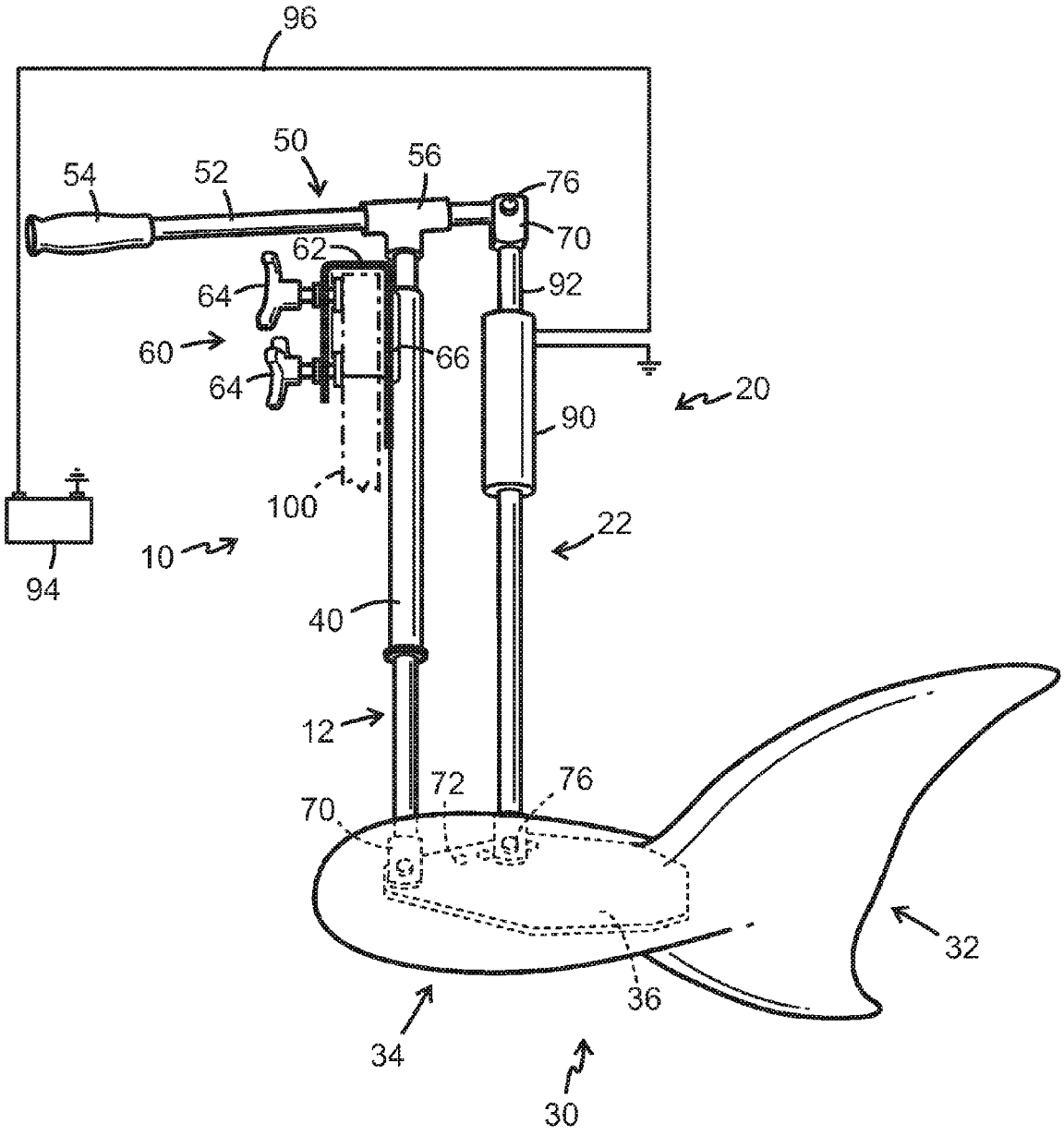
FIG. 3 is a view corresponding to FIG. 1 of a motor powered watercraft propulsion device.

In the embodiments of FIGS. 1-3 the support link is a substantially vertical steering shaft 12 rotatably supported in a bearing sleeve 40. Bearing sleeve 40 is rigidly connected, for example by a weld 66, to a bracket 60 for attachment to a transom 100 of a watercraft (not shown) to be propelled by the propulsion device 10. In the example shown, the bracket 60 comprises a clamp 62 having a pair of threaded clamp screws 64 (only one is shown in FIG. 2) to securely hold the propulsion device 10 to the transom 100. In this manner, the bracket 60 may be releasably attached to the transom 100, thereby making it possible to remove the propulsion device 10 to reduce the drag when it is not in use, e.g. when rowing the watercraft.

In the design example shown on FIG. 2, the bearing sleeve 40 is provided with a pair of bushings 42, each including an end flange 44 engaging a respective end of sleeve 40. Bushings 42 are kept in place on the steering shaft 12 by a respective retaining ring 46. Thereby, the steering shaft 12 is rotatably but non-slidably supported in the bearing sleeve 40

As is further apparent from FIG. 2, at both ends of the steering shaft 12 there is a respective fork head 70. Each fork head 70 has an internal helical thread 74 to be screwed on to a corresponding external helical thread 14 at the respective end of steering shaft 12.

The drive link 20 comprises a substantially vertically reciprocable connecting rod 22. The opposite ends of rod 22 are also provided with fork heads 70.

Each fork head 70 has further a lateral bore 72 adapted to be pivotally connected by pins 76 (FIGS. 1 and 3) to corresponding bores 72 of the parts later described in detail to which the fork heads 70 are connected.

The steering shaft 12 and the connecting rod 22 are pivotally connected to the propulsion unit 30, by their lower fork heads 70, more precisely to the fore support body 34 thereof. In the examples shown, the fore support body 34 comprises a streamline shaped body of an elastic or resilient material, suitably polyurethane, which is integrally formed with the propulsion fin 32. Propulsion fin 32 and its transition portion to the support body 34 are shaped, for example, as a molding of a bottlenose dolphin, having a rearward increasing elasticity or compliancy, as diagrammatically indicated by phantom lines in FIG. 4. Thereby, the propulsion unit 30 is capable of propelling itself and the watercraft forward in a surrounding water volume when the propulsion unit 30 including the fin 32 is subjected to an upward and downward oscillating movement by the drive link 20 about the lower end of the steering shaft 12.

In the exemplary embodiments of FIGS. 1-3, a connecting link 36 is anchored by being molded into the support body 34. The two lower fork heads 70 of support link 12 and drive link 20 are pivotally connected to the connecting link 36 at a possibly variable distance by connection to a selected pair of a plurality of bores 72 in the connecting link 36. While the resulting pivot joints may be located at the outside of the support body 34, in the example shown in FIG. 2 they are located in a recess 38 of the support body 34.

By their upper fork heads 70, the steering shaft 12 and the drive link 22 are connected to the control link 50.

In the examples shown on FIGS. 1 and 2, both the support link 12 and the drive link 20 are pivotally connected to the control link 50 through the fork heads 70 and corresponding pivot brackets 56. In this case, the handle bar 52 of the control link 50 is both a manual drive lever and a tiller for controlling the direction of travel of the watercraft. Accordingly, a user (not shown) holding the handle grip 54 is then capable of both steering the watercraft and bring the propulsion unit 30 into a propulsive movement via the drive link 20 by an upward and downward pumping arm movement of the handle bar 52.

In the embodiment according to FIG. 3 only the drive link 20 is pivotally connected to the control link 50 while the support link 12 is rigidly connected to the control link 50, for example by a suitably dimensioned T-pipe joint 56. The drive link 20 is in this case supplemented by a reciprocating linear actuator in the shape of an electrical linear motor 90 having a reciprocating drive rod 92. As further indicated in FIG. 3, the driving power for motor 90 can be provided by a power source 94, such as a automotive or marine battery, via an electric power line 96. As an alternative to an electric motor, the reciprocating linear actuator 90 may instead be e.g. a hydraulic or a pneumatic motor. The power source 94 then comprises a hydraulic pump or an air compressor, respectively, which provides power to the linear acturator 90 via pressurized fluid lines 96 that comprise appropriate valve arrangements (not shown) for controlling the motion of the linear power actuator 90.

Figure 4:
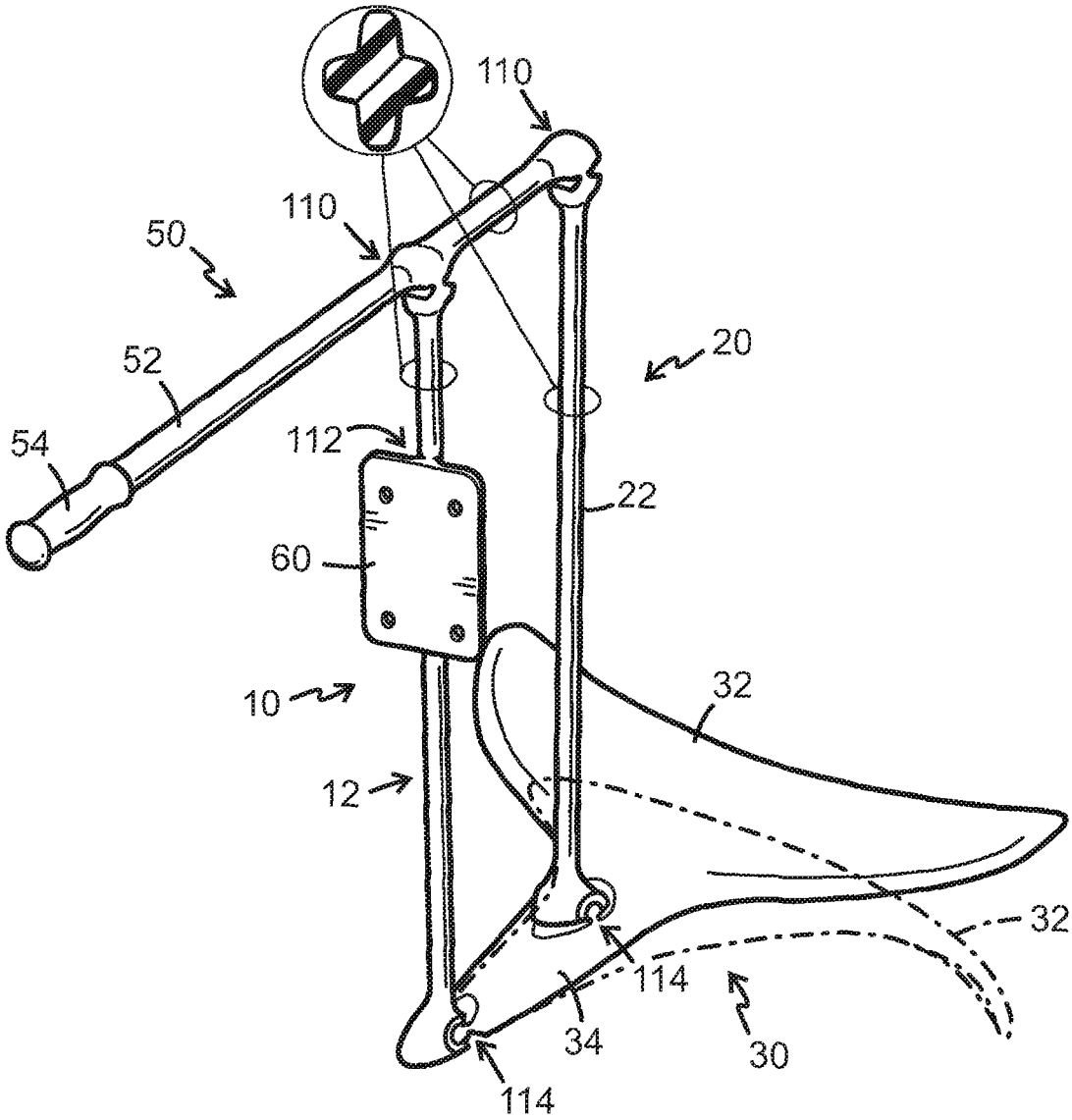
FIG. 4 is a perspective view from above of a modified embodiment of a watercraft propulsion device.

The embodiment according to FIG. 4 illustrates the possibility of producing a propulsion device according to the invention from a few integral parts, for example by injection molding of a plastics material. As indicated in the encircled enlarged area of FIG. 4, the shaft portions 12, 22, 50 of the device may also have a cross-sectional shape that is optimized for strength and adapted for injection molding. The support, drive and control links 12, 20, 50, and preferably also the transom bracket 60, are formed in one piece, including integrally shaped upper pivot joints 110, and preferably also an integrally shaped steering axis pivot joint 112, all provided with bending notches in the plastics material. The lower pivot joints 114 to the support body 34 of the propulsion unit 30 are indicated as shaped integrally with the propulsion unit 30 and interconnected with the steering link 12 and the drive link 20, for example by profiles in slidable engagement to each other. It is, however, conceivable to mold the propulsion device 10 in a single piece of plastics material, possibly also by mixing materials of different strength and elastic properties in a coinjection molding process.

While in the description above with reference to FIG. 3, the linear power actuator 90 is located in the rearward link, as an alternative, the linear power actuator 90 may as well be located in the forward link. In the embodiment of FIG. 3, for example, one possible location of the linear power actuator 90 would be in the forward link below the bearing sleeve 40.

The foregoing detailed description is given primarily for clearness of understanding and no unnecessary limitations are to be understood therefrom. Modifications will become obvious to those skilled in the art upon reading this disclosure and may be made without departing from the spirit of the invention or the scope of the appended claims.

The invention claimed is:

1. A watercraft propulsion device including a linkage which comprises a vertical drive link, a support link, an upper control link having a forwardly extended handle bar, and a lower propulsion link having a horizontal propulsion fin extending backwards therefrom, said control link and said propulsion link being interconnected by said support link and by said drive link, which is capable of conveying propulsive oscillatory motion to the propulsion link, said linkage being pivotally connected to a transom bracket such that it can pivot about a substantially vertical axis, the propulsion device being characterized in comprising a linear power actuator included in said drive link for generating said oscillatory motion.

2. The watercraft propulsion device according to claim 1, said control and propulsion links being interconnected rearwardly by said drive link, and forwardly by said support link, said support link being pivotally connected to said transom bracket about said substantially vertical axis.

3. The watercraft propulsion device according to claim 2, said support link comprising a shaft, which is rotatably and non-slidably supported in a bearing sleeve connected to said transom bracket.

4. The watercraft propulsion device according to claim 1, wherein said power actuator is an electric, a pneumatic, or a hydraulic power actuator.

5. The watercraft propulsion device according to claim 1, wherein said propulsion link comprises a forward support body connected to the propulsion fin.

6. The watercraft propulsion device according to claim 5, wherein said support body is formed of a flexible plastics material integrally with the propulsion fin.

7. The watercraft propulsion device according to claim 5, wherein said support body has a streamline shape.

8. The watercraft propulsion device according to claim 6, wherein said support body comprises a connection link anchored in said plastics material, and is pivotally connected to said support link and said drive link.

9. The watercraft propulsion device according to claim 1, wherein lower ends of said support and drive links are pivotally connected to said propulsion link at a variable mutual distance.

10. The watercraft propulsion device according to claim 2, wherein said power actuator is an electric, a pneumatic, or a hydraulic power actuator.

11. The watercraft propulsion device according to claim 3, wherein said power actuator is an electric, a pneumatic, or a hydraulic power actuator.

12. The watercraft propulsion device according to claim 2, wherein said propulsion link comprises a forward support body connected to the propulsion fin.

13. The watercraft propulsion device according to claim 3, wherein said propulsion link comprises a forward support body connected to the propulsion fin.

14. The watercraft propulsion device according to claim 4, wherein said propulsion link comprises a forward support body connected to the propulsion fin.

15. The watercraft propulsion device according to claim 6, wherein said support body has a streamline shape.

16. The watercraft propulsion device according to claim 7, wherein said support body comprises a connection link anchored in said plastics material, and is pivotally connected to said support link and said drive link.

17. The watercraft propulsion device according to claim 2, wherein lower ends of said support and drive links are pivotally connected to said propulsion link at a variable mutual distance.

18. The watercraft propulsion device according to claim 3, wherein lower ends of said support and drive links are pivotally connected to said propulsion link at a variable mutual distance.

19. The watercraft propulsion device according to claim 4, wherein lower ends of said support and drive links are pivotally connected to said propulsion link at a variable mutual distance.

20. The watercraft propulsion device according to claim 5, wherein lower ends of said support and drive links are pivotally connected to said propulsion link at a variable mutual distance.

* * * * *